US008910559B1

(12) United States Patent
Berman

(10) Patent No.: US 8,910,559 B1
(45) Date of Patent: Dec. 16, 2014

(54) SYSTEM AND METHOD FOR MODULAR TURRET EXTENSION

(71) Applicant: Christopher Berman, Mount Airy, NC (US)

(72) Inventor: Christopher Berman, Mount Airy, NC (US)

(73) Assignee: Granite Tactical Vehicles Inc., Mount Airy, NC (US)

( * ) Notice: Subject to any disclaimer, the term of this patent is extended or adjusted under 35 U.S.C. 154(b) by 22 days.

(21) Appl. No.: 13/899,413

(22) Filed: May 21, 2013

Related U.S. Application Data

(60) Provisional application No. 61/649,817, filed on May 21, 2012.

(51) Int. Cl.

| | |
|---|---|
| ***F41H 5/20*** | (2006.01) |
| ***F41H 5/26*** | (2006.01) |
| ***F41H 7/02*** | (2006.01) |
| ***F41H 7/04*** | (2006.01) |

(52) U.S. Cl.
CPC ..... *F41H 5/20* (2013.01); *F41H 5/263* (2013.01); *F41H 7/02* (2013.01); *F41H 7/048* (2013.01)
USPC ..... 89/36.08; 89/36.09; 89/36.13; 89/935

(58) Field of Classification Search
CPC ..... F41H 5/18; F41H 5/20; F41H 5/226; F41H 5/26; F41H 5/263
USPC ..... 89/36.08, 36.13, 36.14, 36.15, 37.22, 89/41.17, 918, 919, 920, 929, 930, 935, 89/936
See application file for complete search history.

(56) References Cited

U.S. PATENT DOCUMENTS

| | | | | | |
|---|---|---|---|---|---|
| 3,131,598 | A * | 5/1964 | Bair | 89/36.08 |
| 3,348,451 | A * | 10/1967 | Vickers | 89/36.13 |
| 3,429,222 | A * | 2/1969 | Flannery et al. | 89/41.02 |
| 3,566,742 | A * | 3/1971 | Bemiss | 89/40.02 |
| D251,289 | S * | 3/1979 | Larson | D12/12 |
| 4,601,230 | A * | 7/1986 | LeBlanc | 89/1.2 |
| 4,667,565 | A * | 5/1987 | Anderson | 89/36.08 |
| 5,257,769 | A * | 11/1993 | Nystrom | 248/681 |
| 7,478,580 | B1 * | 1/2009 | Parimi et al. | 89/36.13 |
| 8,146,480 | B2 * | 4/2012 | Schneider et al. | 89/36.13 |
| 8,402,877 | B1 * | 3/2013 | Petrosillo et al. | 89/36.03 |
| 2009/0120274 | A1 * | 5/2009 | Schneider et al. | 89/36.08 |
| 2010/0011948 | A1 * | 1/2010 | Johnson et al. | 89/36.02 |
| 2010/0126337 | A1 * | 5/2010 | Carter | 89/36.02 |
| 2011/0154981 | A1 * | 6/2011 | Schneider et al. | 89/36.08 |
| 2012/0024143 | A1 * | 2/2012 | Shacklee et al. | 89/41.02 |
| 2012/0036989 | A1 * | 2/2012 | Kachtan et al. | 89/36.08 |
| 2013/0000473 | A1 * | 1/2013 | Schvartz et al. | 89/33.2 |
| 2014/0083284 | A1 * | 3/2014 | Chu et al. | 89/36.02 |

* cited by examiner

*Primary Examiner* — Bret Hayes
*Assistant Examiner* — Derrick Morgan
(74) *Attorney, Agent, or Firm* — Orrick, Herrington & Sutcliffe LLP

(57) ABSTRACT

A modular turret extension system for providing improved situational awareness and methods for manufacturing and using same is provide herein. The turret extension system includes a first and second coupling end, a plurality of extension members extending between the first and second coupling end, a viewing chamber defined by the first and second coupling ends and the plurality of extension members and a plurality of viewing ports each defined by a portion of one or more of the extension members.

14 Claims, 3 Drawing Sheets

SYSTEM AND METHOD FOR MODULAR TURRET EXTENSION

CROSS-REFERENCE TO RELATED APPLICATIONS

This application claims the benefit of U.S. Provisional Application No. 61/649,817, filed May 21, 2012, which application is hereby incorporated herein by reference.

FIELD

The present disclosure relates generally to combat vehicles and more particularly, but not exclusively, to systems and methods for providing a modular turret extension.

BACKGROUND

Combat vehicles such as the High Mobility Multipurpose Wheeled Vehicle (HMMWV) may be configured with a roof ring mount that allows various weapons systems to be mounted to the roof of the vehicle. For example, Remote Weapons Systems (RWS) including light and heavy machine guns, rockets, or missiles may be mounted to the top of a HMMWV. Such weapons systems allow a gunner or other operator to move, target and fire the system via a remote control. Many RWS remote controls include a video screen which provides images from one or more camera mounted on or about the weapons system and allow the gunner to visually acquire targets and otherwise view a battlefield.

However, these systems are deficient because the screens on such remote controls are small, and fail to provide the gunner and other personnel in a combat vehicle with adequate situational awareness. Cameras provide only a limited field of view, are typically difficult to control, and move slowly. Unfortunately, with the gunner's observations limited to a small field of view presented on the display, the gunner must depend on other vehicle crew members to locate targets. Even once targets are acquired, there can be substantial lag time between locating a target and acquiring the target with the RWS. Such a lag time creates an unacceptable danger for the vehicle crew.

In view of the foregoing, a need exists for a modular turret extension system for providing improved situational awareness in an effort to overcome the aforementioned obstacles and deficiencies of conventional combat vehicle turret systems.

Figure 1A:
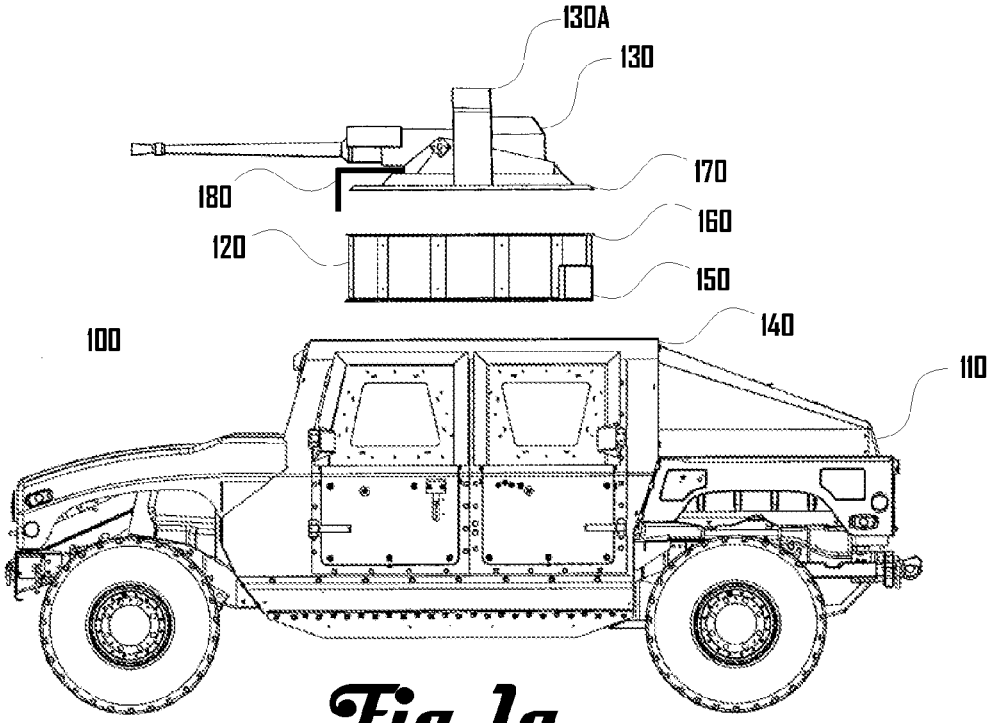
FIG. 1*a* is an exemplary side exploded view drawing illustrating an embodiment of a combat vehicle having a turret and a turret extension system.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Since currently-available turret systems are deficient because they fail to provide for adequate situational awareness for turret gunners, a modular turret extension system that provides a wide field of view while also providing protection for vehicle occupants can prove desirable and provide a basis for a wide range of improved and customized vehicle weapons systems. This result can be achieved, according to one embodiment disclosed herein, by a modular turret extension system as illustrated in FIG. 1*a*-FIG. 3.

Figure 1B:
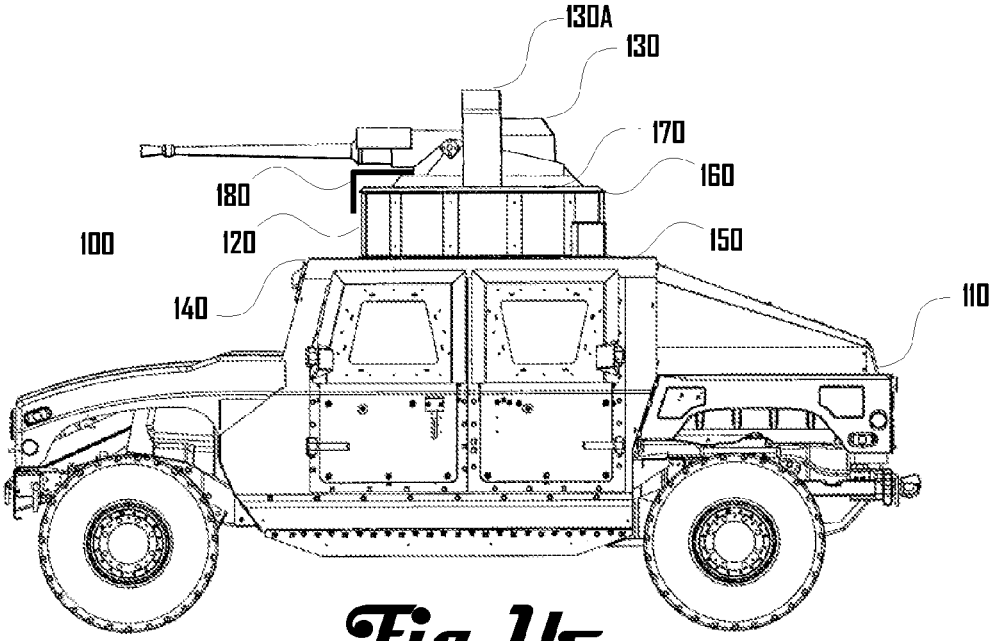
FIG. 1*b* is an exemplary side view drawing illustrating the combat vehicle of FIG. 1 wherein the turret and turret extension system are coupled to the combat vehicle.

Turning to FIGS. 1*a* and 1*b*, a combat vehicle system 100 is shown comprising a combat vehicle 110, a turret extension 120, and a turret 130. FIG. 1*a* depicts the combat vehicle system 100 in an exploded view, whereas FIG. 1*b* depicts the combat vehicle 110, the turret extension 120, and the turret 130 coupled together.

The combat vehicle 110 comprises a roof 140 to which the turret extension 120 is coupled at a bottom coupling end 150 of the turret extension 120. The turret extension 120 further comprises a top coupling end 160, to which the turret 130 is coupled via a turret base 170.

Figure 2:
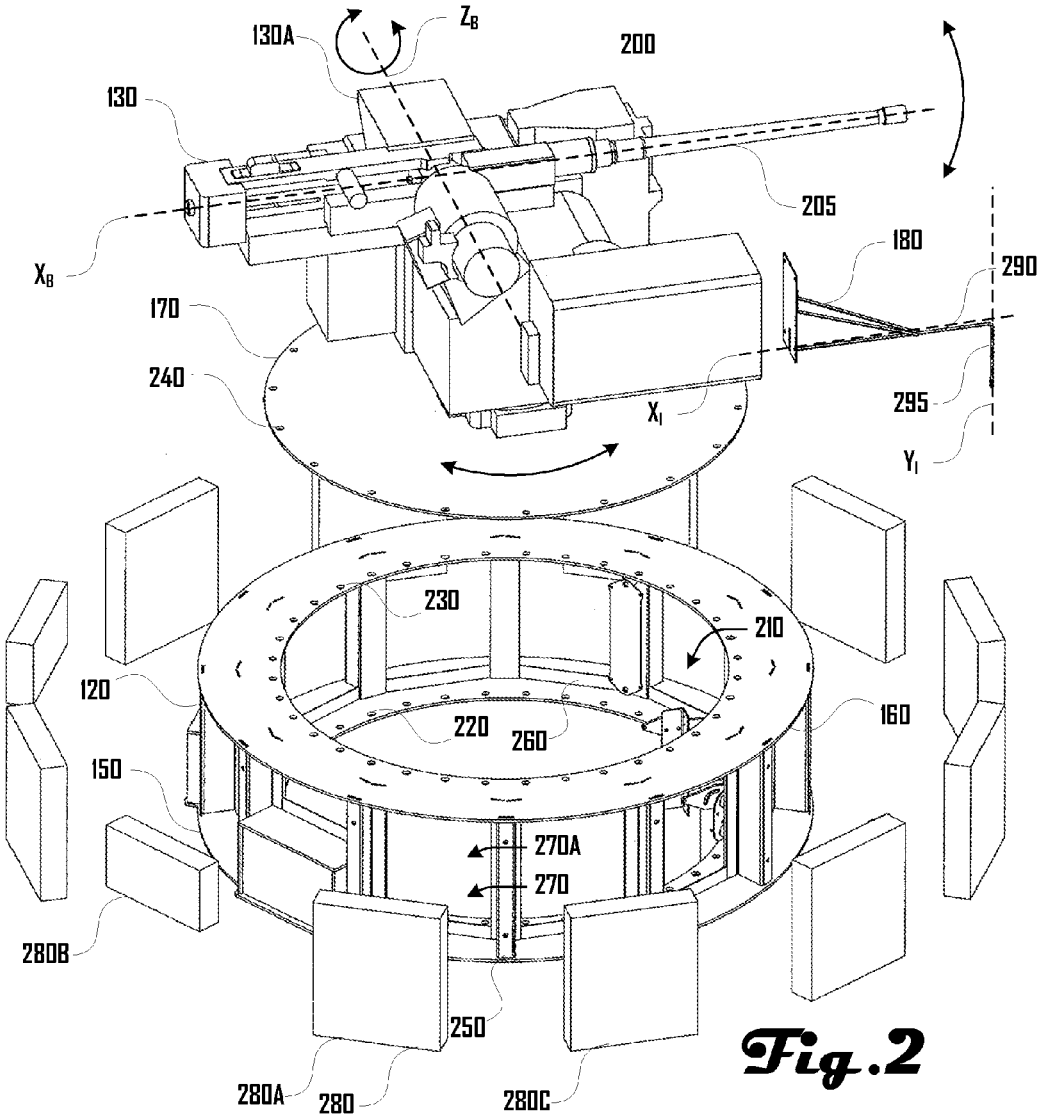
FIG. 2 is an exemplary perspective exploded view drawing illustrating an embodiment of a turret and a turret extension system.
Figure 3:
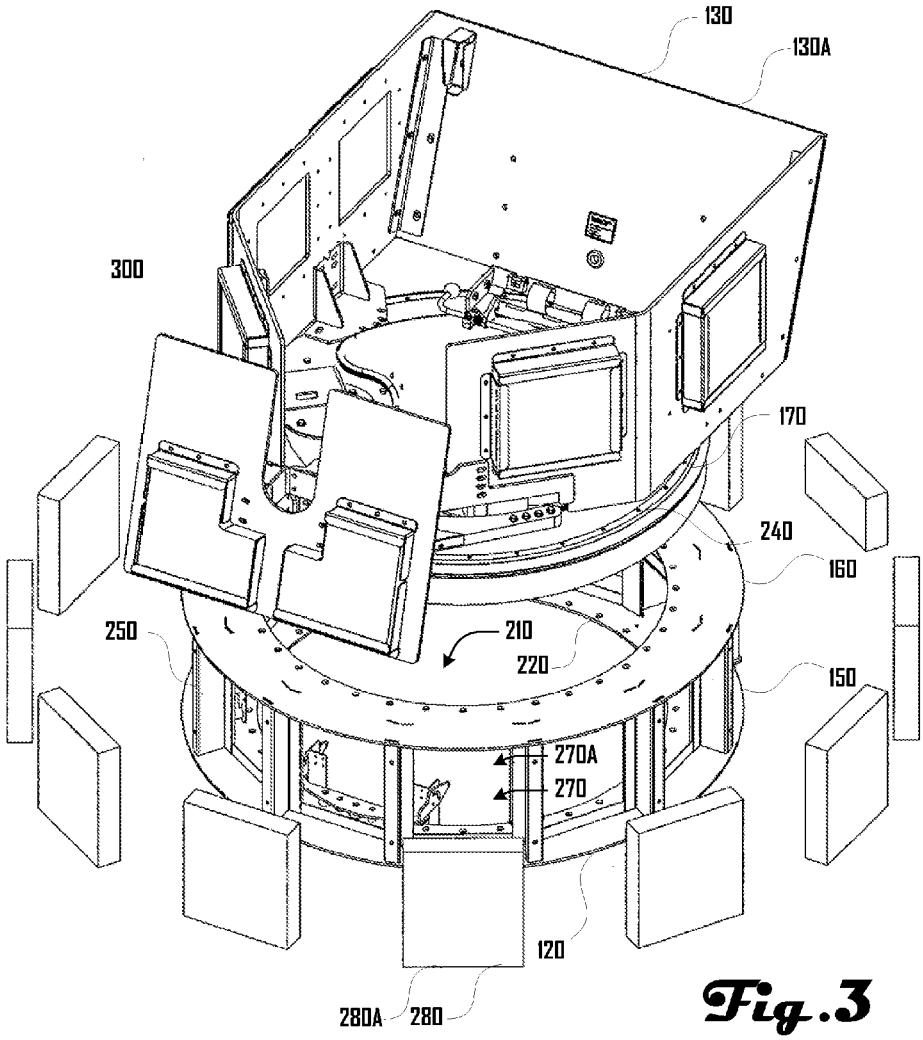
FIG. 3 is an exemplary perspective exploded view drawing illustrating another embodiment of a turret and a turret extension system.

FIG. 1*a*, FIG. 1*b*, and FIG. 2 depict an automated Browning M2 .50 caliber machine gun turret 130A, which is configured to be remotely operated by a gunner positioned inside of the vehicle 110 and/or turret extension 120, wherein the targeting and fire control occurs via a remote control that moves and fires the gun turret 130A. However, in various embodiments various turrets or gunner protection kits (GPKs), or the like, may be modularly coupled with a vehicle 110, via the turret extension 120. For example, FIG. 3 depicts a GPK used with the turret extension 120.

Additionally, weapon systems of various types may be used with the turret extension 120 or a system coupled with the turret extension 120, including one or more, small arms, light machine guns (LMG), heavy machine guns (HMG), artillery, grenade launchers, rocket launchers, missile launchers, or the like, without limitation. Such systems may include a Remote Weapons System (RWS). Additionally, non-weapons systems may also be used with the turret extension 120, including a surveillance system, non-lethal weapons system, targeting system, or the like, without limitation.

In some embodiments, an extension cap (not shown) may be coupled to the top end 160 of the turret extension 120 when a turret 130 or other system is not coupled to the top of the turret extension 120. This may be desirable so as to maintain the armor envelop of the vehicle 110 when a turret 130 or other system is not present on the turret extension 120. The extension cap may comprise a substantially planar circular body and may be similar to the turret base 170. The extension cap may include a hatch, door or other opening in some embodiments.

Additionally, although FIGS. 1*a* and 1*b* depict the turret extension 120 coupled to a HMMWV vehicle 110, in some embodiments, the turret extension 120 may be used on, or configured for use on, various other types of combat vehicles, including armored personnel carriers (APCs), main and light tanks, and infantry fighting vehicles. In further embodiments, the turret extension 120 may be used on, or configured for use on other types of vehicles, including boats, ships and aircraft. The presently disclosed embodiments are only intended to show some of the numerous embodiments of the turret extension 120 and applications thereof.

FIGS. 2 and 3 show an exemplary perspective exploded view drawing illustrating two embodiments 200, 300 of a turret 130A, 130B and a turret extension system 120. The turret extension system 120 comprises a top and bottom coupling end 150, 160 with a plurality of extension members 250 extending between the top and bottom coupling ends 150, 160. The extension members 250 and top and bottom coupling end 150, 160 define a viewing chamber 210, which is a cavity within the turret extension system 120.

The turret extension system 120 can further comprises a plurality of port sills 160, which along with pairs of extension members 250, respectively define a plurality of viewing ports 270. In various embodiments, viewing ports 270 may be defined by a portion of any of the extension members 250, port sills 160, port headers (not shown), the bottom and top coupling ends 150, 160, or the like. A plurality of viewing panes 280 are each configured to be removably disposed within a respective viewing port 270. For example, as shown in FIGS. 2 and 3 viewing pane 280A is configured to reside within viewing port 270A.

In various embodiments, the viewing ports 270 and respective viewing panes 280 may be any suitable size or shape, and may be uniform or non-uniform. For example, FIGS. 2 and 3, depict some of the viewing panes 280B being smaller than other viewing panes 280A. Additionally, any of the extension members 250, port sills 160, the port headers (not shown), the top and bottom coupling ends 150, 160, or the like may be any suitable size, and various systems may be disposed therein or attached thereto, including electronics or the like. In various embodiments, viewing panes 280 are present in substantially 360° around the circumference or outer surface of the turret extension system 120; however, in some embodiments, viewing panes 280 may only be present on some portions or at certain intervals around the circumference or outer surface of the turret extension system 120.

The viewing panes 280 may be transparent and thereby allow users, gunners or vehicle operators within the viewing chamber 210 or vehicle 110 to see out of the turret extension system 120. In some embodiments, the viewing panes 280 may comprise ballistic glass, transparent armor, or bullet-resistant glass, or the like, without limitation. For example, the viewing panes 280 may be constructed using polycarbonate, thermoplastic, and layers of laminated glass or plastic. Products such as Armormax, Makroclear, Cyrolon, Lexan and Tuffak are examples of products that may be suitable to comprise a viewing pane 280. Viewing panes 280 may conform to the United States Department of Defense (DoD) specifications for transparent armor, or other specifications, or requirements, or standards for transparent armor, or the like.

Because the turret extension system 120 may be exposed to combat situations, it may be desirable for the viewing panes 280 to be removable or replaceable in situations where viewing panes 280 are damaged by ballistics, explosives, or the like. Accordingly, the viewing panes 280 may be one or both of outwardly removable as show in FIGS. 2 and 3, or inwardly removable (i.e., toward the viewing chamber 210).

In addition to the armored properties of the viewing panes 280, various other portions of the turret extension system 120 may have ballistic-resistant, armored, or bullet-resistant properties. For example, parts such as the extension members 250, port sills 160, the port headers, the extension cap, and the top and bottom coupling ends 150, 160, or the like, may comprise armor steel or other suitable material. In some embodiments, portions of, or the turret extension system 120 itself may conform to DoD specifications for opaque armor, or other specifications, or requirements, or standards for opaque armor, or the like.

The turret extension system 120 may be configured to modularly couple with a standard HMMWV roof ring mount and configured to modularly couple with systems configured for use with a standard HMMWV roof ring mount. For example, FIGS. 2 and 3 depict a turret extension 120 comprising a bottom coupling end 150 that comprises a bottom-end coupling architecture 220 (i.e., a plurality of bolt holes) that correspond to a HMMWV roof ring mount (not shown). The turret extension 120 further comprises a top coupling end 160 comprising a top-end coupling architecture 230 (i.e., a plurality of bolt holes), to which the turret 130 is coupled via the turret base 170 via a turret-base coupling architecture 240 (i.e., a plurality of bolt holes). The top-end coupling architecture 230 corresponds to a standard HMMWV roof ring mount (not shown), which in turn corresponds to the turret-base coupling architecture 240, and bottom-end coupling architecture 220.

Accordingly, a turret extension 120 may provide for modular reconfiguration of a combat vehicle 110 (FIG. 1), or the like. For example, various turrets (e.g., 130A, 130B) having a standardized turret-base coupling architecture 240 can be coupled directly to the roof 140 of a vehicle 110 that has a corresponding roof coupling architecture (not shown). Alternatively, various turrets (e.g., 130A, 130B) having the standardized turret-base coupling architecture 240 can be coupled with the top-end coupling architecture 230 of the turret extension 120, which is coupled to the vehicle 110 via coupling of the roof coupling architecture (not shown) and bottom-end coupling architecture 220.

While a standard HMMWV roof ring mount is used as an example in the present disclosure, other standard ring mounts, non-standard ring mounts, or mounts of other shapes may be accommodated by a turret extension 120 in accordance with some embodiments. Additionally, mounts and coupling architecture may comprise various suitable structures including bolts, bolt holes, pins, slots, hooks, flanges, or the like without limitation.

Additionally, a turret extension 120 may be any suitable size, height, width, or circumference. Moreover, while a turret extension 120 is depicted herein having first and second coupling ends that are substantially parallel and comprising a substantially planar ring, some embodiments may comprise various regular or irregular geometric shapes including ovals, octagons, squares, or the like. Also, although the presently disclosed embodiments depict a turret extension 120 having a top end 160 and a bottom end 150 having substantially the same size with the viewing panes 280 substantially perpendicular to the face of the top end 160 and bottom end 150, in some embodiments the top end 160 and bottom end 150 may be different sizes and/or shapes, and in some embodiments the viewing panes may be slanted instead of perpendicular.

As depicted in FIGS. 1*a*, 1*b* and 2, a system 100, 200 can further comprise a barrel location indicator 180, which includes an extension portion 290 and an indicator portion 295. The extension portion 290 may have an extension axis $X_I$ and the indicator portion 295 can have an indicator axis $Y_I$. Additionally, a turret 130 may comprise a barrel 205 that comprises a barrel axis $X_B$ and the barrel 205 may rotate about a barrel pitch axis $Z_B$. Additionally, the turret 130 may rotate about a turret yaw axis (not shown) that is perpendicular to the barrel pitch axis $Z_B$.

The barrel location indicator 180 can be coupled to the turret 130 such that the indicator axis $Y_I$ is substantially coincident to the barrel axis $X_B$, such that the indicator portion 295 indicates the plane of fire of the barrel 205 regardless of the rotation of the turret 130. The barrel location indicator 180 can extend from the turret 130 and then extend downward along the outer diameter of the turret base 170. In various embodiments, the indicator portion 295 may extend substantially parallel to the outer surface of the turret extension 120 defined by the viewing panes 280 and/or extension members 250.

Accordingly, a gunner or other user within the viewing chamber 210 and/or vehicle 110 can have an indication of the plane of fire of the barrel 205 even if the barrel 205 is not visible through the turret extension 120. Additionally, such an indication of the plane of fire provides for improved target acquisition compared to simply using a targeting screen, which is typical in conventional remotely operated weapons systems.

For example, conventional remotely operated turrets include one or more camera mounted on the turret, which allows a gunner to acquire targets via camera images presented on a display screen. However, cameras have a limited field of view, and cannot quickly zoom in and out and typically cannot move quickly. Moreover, many systems require the whole turret to move for the camera to move. In contrast, in various embodiments, the turret extension 120 allows one or more gunner or user to have 360° situational awareness by viewing battlefield conditions directly through the viewing panes 280. Targets can be acquired visually via the turret extension 120; the turret 130 can be moved toward the target and generally sited via the barrel location indicator 180; and then specifically targeted via a targeting screen. This targeting method can provide substantially faster target recognition and acquisition, which can be desirable in battlefield conditions. Moreover, the gunner and other users can maintain overall situational awareness, even while acquiring specific targets.

For example, a gunner may identify a first hostile target at approximately 9:00, and move the turret 130 from a 12:00 position to an approximately 9:00 and generally line up the barrel 205 with the target using the barrel location indicator 180 as a guide. In some situations, more specific targeting may not be required, and the gunner may fire a shot without further targeting; however, more specific targeting may be achieved via a turret camera display. Additionally, while the gunner is acquiring the first hostile target, another crew member in the vehicle 110 may visually identify a second hostile target at 3:00 in the opposite direction of the first hostile target. Accordingly, 360° visual situational awareness may be maintained, even while one target is being acquired.

Various suitable targeting systems may be employed with the turret extension 120, in accordance with some embodiments. For example, a heads-up display, which may include a touch-display, may be used proximate to one or more of the viewing panes 280 for controlling a turret 130 and for targeting. Additionally, target acquisition may include lasers or light of various spectrums being projected through one or more of the viewing panes 280.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives.

What is claimed is:

1. A combat vehicle turret extension system comprising:
- a first and second coupling end;
  - wherein the first and second coupling ends further comprise complementary coupling architectures configured to couple to a roof of a combat vehicle and configured to couple to a turret, respectively;
- a plurality of extension members extending between the first and second coupling ends;
- a viewing chamber defined by the first and second coupling ends and the plurality of extension members;
- a plurality of viewing ports each defined by a portion of one or more of the extension members;
- the turret comprising:
  - a turret-base coupling architecture configured to couple with the second end coupling architecture;
    - wherein the turret further comprises a barrel extending outwardly from a portion of the turret, and
    - wherein the turret comprises a barrel location indicator extending down toward the turret extension system and proximate to the outer circumference of the turret extension system.

2. The combat vehicle turret extension system of claim 1, wherein the first and second coupling ends are substantially parallel and comprise a substantially planar ring.

3. The combat vehicle turret extension system of claim 2, wherein each of the plurality of extension members extend perpendicularly between the first and second coupling ends.

4. The combat vehicle turret extension system of claim 1, further comprising a plurality of viewing panes, each disposed in one of the plurality of viewing ports.

5. The combat vehicle turret extension system of claim 1, wherein the viewing panes comprise a transparent ballistic material.

6. A combat vehicle comprising:
- a vehicle roof comprising:
  - a roof orifice,
  - and a roof coupling architecture,
- a turret extension system comprising:
  - a bottom coupling end comprising a bottom-end coupling architecture configured to couple with the roof coupling architecture;
  - a top coupling end comprising a top-end coupling architecture configured to couple with a turret-base coupling architecture;
  - a plurality of extension members extending between the first and second coupling end;
  - a viewing chamber defined by the first and second coupling ends and the plurality of extension members; and
  - a plurality of viewing ports each defined by a portion of one or more of the extension members; and
- a turret comprising:
  - a turret-base coupling architecture configured to couple with the top-end coupling architecture;
  - wherein the turret further comprises a barrel extending outwardly from a portion of the turret, and
  - wherein the turret comprises a barrel location indicator extending down toward the turret extension system and proximate to the outer circumference of the turret extension system.

7. The combat vehicle of claim 6, wherein the first and second coupling ends are substantially parallel and comprise a substantially planar ring.

8. The combat vehicle of claim 7, wherein each of the plurality of extension members extend perpendicularly between the first and second coupling ends.

9. The combat vehicle of claim 6, further comprising a plurality of viewing panes, each disposed in one of the plurality of viewing ports.

10. The combat vehicle of claim 6, wherein the viewing panes comprise a transparent ballistic material.

11. The combat vehicle of claim 6, wherein the turret extension system is coupled to the vehicle roof via the bottom end and the turret is coupled to the turret extension system via the top end.

12. The combat vehicle of claim 6, wherein the turret is configured to rotate; and wherein the barrel location indicator is configured to track the outer circumference of the turret extension system.

13. The combat vehicle of claim 6, wherein the combat vehicle comprises a HMMWV.

14. The combat vehicle of claim 6, wherein the turret comprises a remote weapons system.

* * * * *